US009797103B2

(12) United States Patent
James

(10) Patent No.: US 9,797,103 B2
(45) **Date of Patent: *Oct. 24, 2017**

(54) POSTS

(71) Applicant: VALMONT HIGHWAY TECHNOLOGY LIMITED, Auckland (NZ)

(72) Inventor: Dallas Rex James, North Harbour (NZ)

(73) Assignee: VALMONT HIGHWAY TECHNOLOGY LIMITED, Auckland (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 14/927,910

(22) Filed: Oct. 30, 2015

(65) Prior Publication Data

US 2016/0047094 A1 Feb. 18, 2016

Related U.S. Application Data

(60) Division of application No. 14/251,205, filed on Apr. 11, 2014, now Pat. No. 9,243,375, which is a continuation of application No. 13/221,567, filed on Aug. 30, 2011, now Pat. No. 8,757,597.

(30) Foreign Application Priority Data

Sep. 2, 2010 (NZ) ..... 587732

(51) Int. Cl.

| | |
|---|---|
| ***E01F 15/06*** | (2006.01) |
| ***E01F 15/14*** | (2006.01) |
| ***E01F 15/00*** | (2006.01) |

(52) U.S. Cl.

CPC ..... *E01F 15/06* (2013.01); *E01F 15/00* (2013.01); *E01F 15/143* (2013.01)

(58) Field of Classification Search

CPC . E01F 9/0182; E01F 15/0461; E01F 15/0438; E01F 15/06

See application file for complete search history.

(56) References Cited

U.S. PATENT DOCUMENTS

| | | | |
|---|---|---|---|
| 6,065,738 | A | 5/2000 | Pearce et al. |
| 6,065,894 | A | 5/2000 | Wasson et al. |
| 6,254,063 | B1 | 7/2001 | Rohde et al. |
| 6,264,162 | B1 | 7/2001 | Barnes et al. |
| 6,488,268 | B1 | 12/2002 | Albritton |
| 6,516,573 | B1 | 2/2003 | Farrell et al. |
| 6,619,630 | B2 | 9/2003 | Albritton |
| 6,729,607 | B2 | 5/2004 | Alberson et al. |
| 6,932,327 | B2 | 8/2005 | Alberson et al. |
| 2002/0030183 | A1 | 3/2002 | Albritton |
| 2003/0213946 | A1 | 11/2003 | Alberson |
| 2006/0017048 | A1 | 1/2006 | Alberson et al. |

(Continued)

FOREIGN PATENT DOCUMENTS

| | | |
|---|---|---|
| GB | 2417509 | 3/2006 |
| WO | 0040805 | 7/2000 |
| WO | 2007129915 | 11/2007 |

*Primary Examiner* — Jonathan Masinick

(74) *Attorney, Agent, or Firm* — Greer, Burns & Crain, Ltd.

(57) ABSTRACT

A method for releasing at least one anchor cable from a terminal post in a cable barrier, after an inline impact, including deforming the terminal post from a straight upright configuration to a bent inclined configuration where the deformation creates a suitably sized aperture in the post which enables release of the anchor cable.

6 Claims, 4 Drawing Sheets

(56) References Cited

U.S. PATENT DOCUMENTS

| | | | |
|---|---|---|---|
| 2006/0093430 | A1 | 5/2006 | Bergendahl |
| 2007/0102689 | A1 | 5/2007 | Alberson et al. |
| 2009/0272956 | A1 | 11/2009 | Abu-Odeh et al. |
| 2010/0192482 | A1 | 8/2010 | James |
| 2011/0095250 | A1 | 4/2011 | Dyke et al. |
| 2011/0127480 | A1 | 6/2011 | Sicking et al. |

POSTS

PRIORITY CLAIM

This Application is a divisional application of and claims the benefit of U.S. patent application Ser. No. 14/251,205 filed on Apr. 11, 2014, which is a continuation of and claims priority to U.S. patent application Ser. No. 13/221,567 filed on Aug. 30, 2011, their entire contents of which are incorporated herein by reference.

TECHNICAL FIELD

The present invention relates to improvements in and relating to posts. In particular, posts for use in road barriers or other impact situations.

BACKGROUND

The present invention has particular application to a terminal post in a cable barrier. However, the present invention can also be used in other situations, where a cable is being held under tension, and it is desirable to release the cable, should the post become deformed by an impact.

For ease of reference only the present invention will now be described in relation to cable road barriers.

Terminal posts which release a cable upon an vehicle impact are well known.

The applicant has previously devised an improved anchor-body and terminal post for a cable barrier which is fully described WO2007/129915. This improved terminal post overcomes the ramp and snag situations that can occur when a vehicle impacts the anchor cables of a cable barrier.

The applicant has also invented another terminal post the subject of NZ Patent Application No. 579282 which represents a further improvement to the invention in WO2007/129915 in that it provides a terminal post of unitary construction which is quick, easy and relatively cheap to manufacture yet still achieves the advantages of the terminal post taught in WO2007/129915. Conversely, the terminal post detailed in WO2007/129915 whilst effective in achieving its aims requires a separate anchor body to be fabricated and attached to the upright member of the terminal post which is relatively time consuming and expensive.

The terminal post of the present invention therefore aims to provide a quick release mechanism which is equally effective, as both of the terminal posts discussed above are, are: reducing or preventing an inclined cable anchoring system from acting as a ramp or snag, during impacts from a number of different angles.

It would therefore be useful to have a cable-barrier system or release mechanism that could withstand impact from collisions from both forward and reverse directions. So in addition to reverse direction impacts it can also release at least one downwardly extending anchor-cable of a terminal post of a cable-barrier, in situations where the anchor-cable (s) are capable of acting as a ramp or snag during a collision.

The terminal posts of WO2007/129915 and NZ Patent Application No. 579282 both require the fabrication of separate assemblies or a post of a unique construction. It would therefore be useful if there could be provided a terminal post which was of similar construction to standard barrier posts and only required minimal modifications to achieve the aforementioned advantages. As this would prevent having to stockpile terminal posts.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

It is an object of the present invention to address the foregoing problems or at least to provide the public with a useful choice.

Further aspects and advantages of the present invention will become apparent from the ensuing description which is given by way of example only.

SUMMARY

According to a first aspect of the present invention there is provided, a terminal post for a barrier wherein the post includes:

an upright portion;

characterised in that the upright portion has an aperture positioned, so that in use:

the aperture is located in a region of the upright portion above a ground engaging portion of the upright portion; and wherein located on one side of the aperture is a transverse reinforcing member which includes a slot for receiving a cable;

and wherein there is at least one groove, or pair of notches located beneath the aperture, which form(s) a predetermined fail line, along which the post will deform, upon receiving a substantially inline impact, which causes the transverse member to move so as to release said cable, and wherein the aperture is dimensioned to allow the terminal end of the cable formally retained by the slot to pass therethrough.

The term 'in line' impact refers to an impact which is in-line with the cables retained by the post of the present invention.

The upright portion may have a variety of different forms without departing from the scope of the present invention.

In one preferred embodiment the upright portion may be in the form of an I-beam comprising two parallel flanges connected via a web.

Preferably, the transverse reinforcing member may be separated from the web a set distance of X mm via a support member which extends substantially orthogonally form the web.

In another embodiment the upright portion may be in the form of a beam having a U shaped cross-section.

In a further embodiment the upright portion may be in the form a beam having a C-shaped cross-section.

The aperture is generally positioned half way along the upright so as to be just above the ground engaging portion of the upright portion. However the exact position can vary depending on how much of the post is required to be located in the in the ground.

The transverse reinforcing member may extend over a portion of the opening created by the aperture such that at least a portion of the slot is visible through the aperture.

Importantly the web in which the aperture is located and the transverse reinforcing plate, when the post is viewed side on, are separated a distance which provides sufficient gap, through which the terminal end of the cable can pass, in order to exit the post upon, deformation thereof. This provides an advantage as it increases the effective size of the aperture after the post has deformed through which the terminal end of the cable can pass. Thus, enabling smaller sized apertures to be used than would be the case, if the transverse plate abutted, or was in-line, with the aperture. Furthermore, the gap provides for a faster release of the cable end as the post needs to deform less in order to release the cable.

In some embodiments the post may include horizontal channels into which ground anchor cables can be received.

According to another aspect of the present invention there is provided a barrier which includes a terminal post substantially as described above.

In another embodiment, a method is provided for releasing at least one anchor cable from a terminal post in a cable barrier, after an inline impact, including deforming the terminal post from a straight upright configuration to a bent inclined configuration where the deformation creates a suitably sized aperture in the post which enables release of the anchor cable.

Thus, preferred embodiments of the present invention may have a number of advantages over the prior art which can include:

- providing a trigger post which is of cheap construction;
- providing a trigger post which can be quickly and easily constructed from a standard barrier post;
- providing a trigger post which can prevent anchor cables from snagging and acting as a ramp to vehicles which have an in-line impact with the terminal end of the barrier.

BRIEF DESCRIPTION OF THE DRAWINGS

Further aspects of the present invention will become apparent from the following description which is given by way of example only and with reference to the accompanying drawings in which.

DETAILED DESCRIPTION

Figure 1:
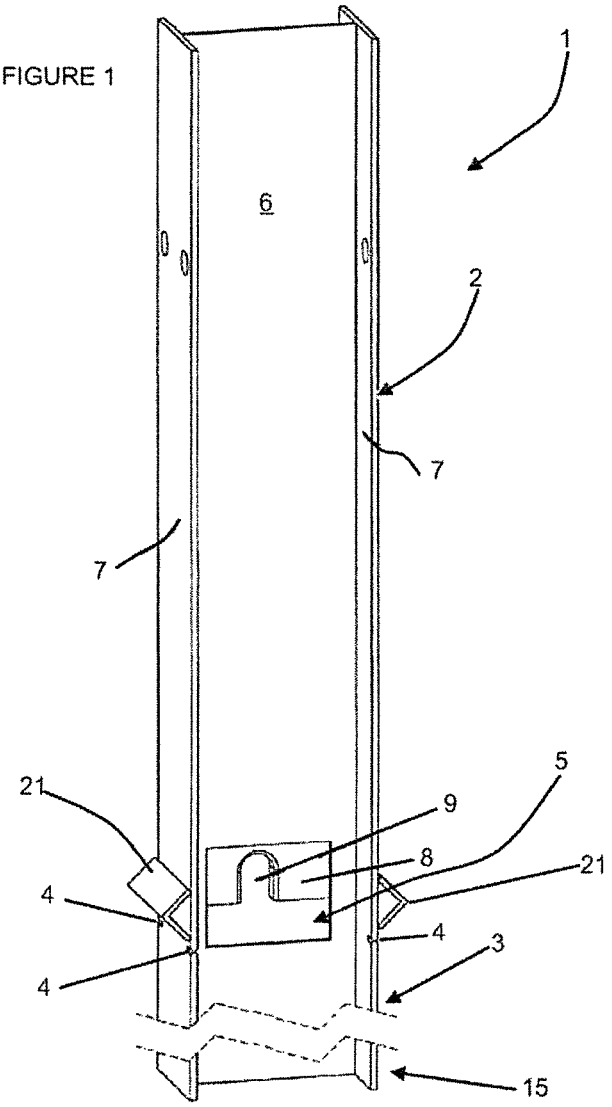
FIG. 1 shows a perspective back view of a portion of a terminal post in accordance with one preferred embodiment of the present invention.

With respect the Figures there is provided a terminal post generally indicated by arrow 1 which has an upright portion 2 formed from a length of I-Beam which, in use, is located above the ground. The post 1 also has a ground engaging portion 3 at one end thereof. The ground engaging portion 3 is generally concreted into the ground (not shown). The ground engaging portion extends from one end 15 of the post 1 to a point underneath two pairs of notches 4 (one on each side flange 7) all aligned in the same horizontal plane.

The upright portion 2 has an aperture 5 located in the connecting web 6 which spans between side flanges 7. Located on one side of the aperture 5 is a transverse reinforcing member 8 which has a slot 9 therein. The slot 9 receives the terminal end of an anchor cable 10 which has a nut 11 and washer 12 thereon.

The transverse reinforcing member 8 is separated from the web 6 a distance shown by double headed arrow X via a horizontal support member 20. The distance X helps reduce the size of aperture 5 whilst still ensuring that there is sufficient gap (as shown by double headed arrow Y) between the bottom of transverse reinforcing member 8 and the aperture 5, for the nut 11 and washer 12 to pass therethrough, when the post is deformed—refer FIG. 2.

Figure 2:
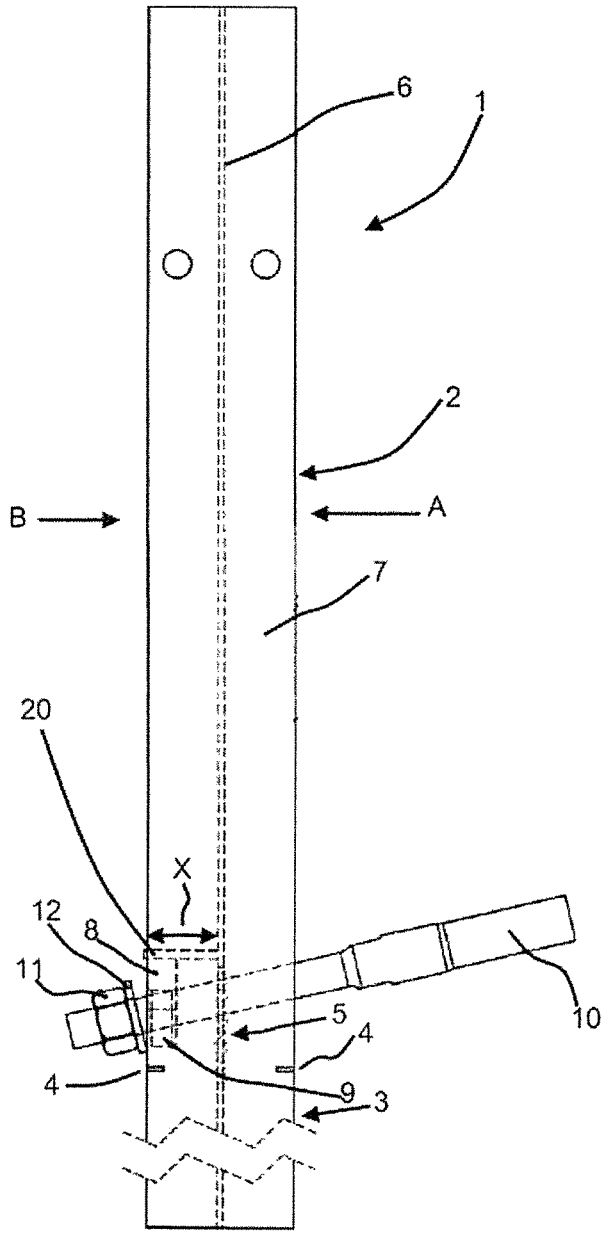
FIG. 2 shows a side view of the terminal post depicted in FIG. 1.

The distance X also helps the transverse reinforcing member 8 lever the end of the cable 10 out of slot 9 when the post deforms after a 'reverse' in-line impact in direction B, see FIG. 2. If a 'front on' in-line impact occurs in direction A the end of the cable simply slides out of slot 9.

The post 1 also has a pair of horizontal sleeves 21 which can receive the ends of a horizontal anchor cables (not shown) which are retained within the sleeves 21 via a nut and washer arrangement (not shown).

Aspects of the present invention have been described by way of example only and it should be appreciated that modifications and additions may be made thereto without departing from the scope of the appended claims.

Figure 3:
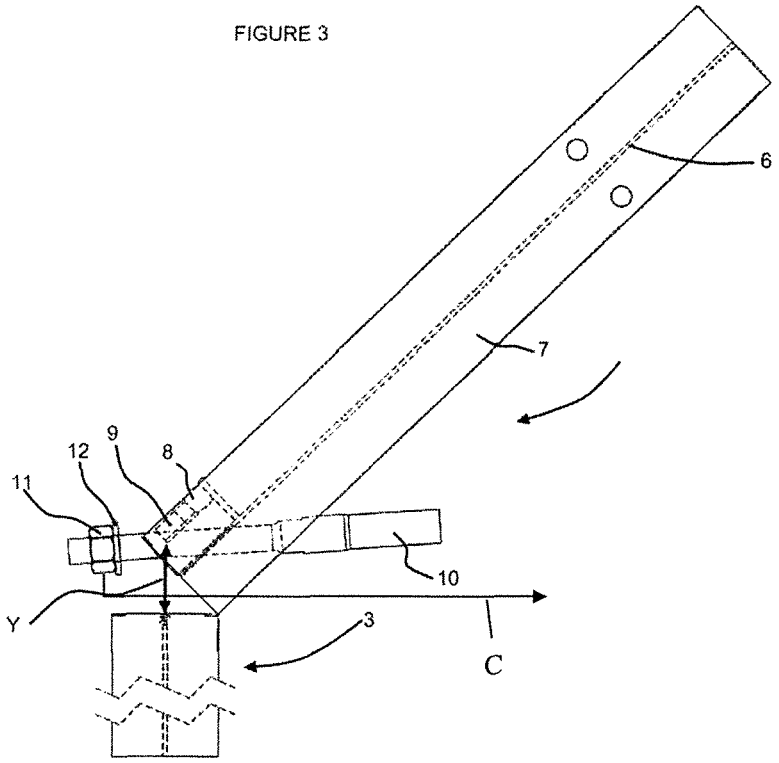
FIG. 3 shows a partial schematic side view of the terminal post shown in FIGS. 1 and 2 in a deformed position.

As can be seen in FIG. 3 when the post 1 deforms the anchor cable 10 is levered out of the slot 9 and can pass through aperture 5, by virtue of being held under tension, in the direction of arrow C.

Figure 4:
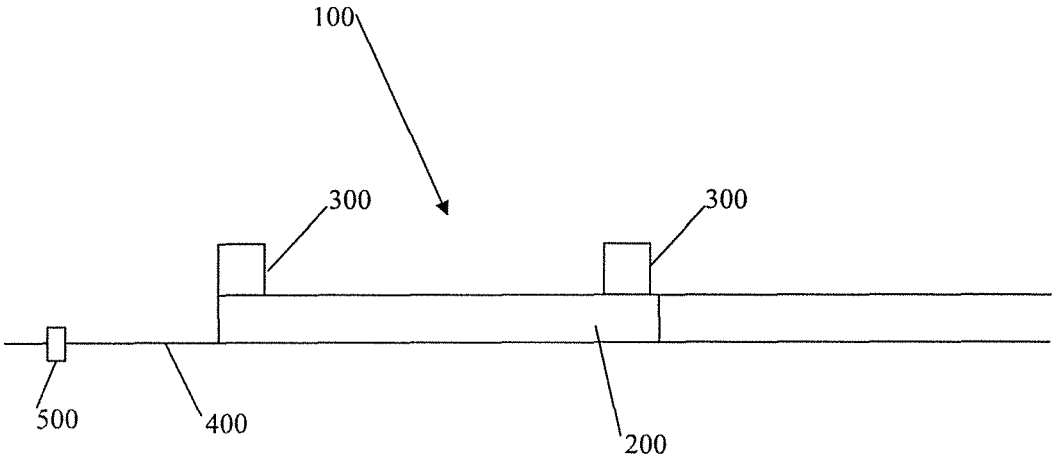
FIG. 4 shows a partial schematic plan view of a barrier including the terminal post shown in FIGS. 1-3.

FIG. 4 shows a barrier 100 which has guardrails 200 and support posts 300. The barrier also includes a terminal cable 400 which is held at one end by terminal post 800.

What is claimed is:

1. A method for releasing at least one anchor cable from a terminal post in a cable barrier, comprising the steps of:

providing a suitably sized aperture in the terminal post, said aperture being adjacent to a slot, wherein at least one anchor cable is secured in said slot;

deforming the terminal post by an inline impact to the terminal post, from a straight upright configuration to a bent inclined configuration; and releasing of a terminal end of the at least one anchor cable from the terminal post through said aperture.

2. The method of claim 1, wherein the deformation of the terminal post causes a further step of: sliding the at least one anchor cable out of a slot before releasing the terminal end of the at least one anchor cable from said terminal post through the suitably sized aperture.

3. The method of claim 2 comprising the step of: levering the terminal end of the at least one anchor cable, so as to cause sliding of the at least one anchor cable out of said slot.

4. The method of claim 1, wherein the deformation of the terminal post occurs along a predetermined fail line.

5. The method of claim 4, wherein the terminal post deforms with at least one of a groove and a pair of notches located beneath the aperture.

6. A method for releasing at least one anchor cable from a terminal post in a cable barrier, comprising the steps of:

providing an aperture and a slot in the terminal post, said aperture being adjacent to and larger in size than said slot, wherein at least one anchor cable is secured in said slot;

deforming the terminal post by an inline impact to the terminal post, from a straight upright configuration to a bent inclined configuration; and releasing of a terminal end of the at least one anchor cable from the terminal post through said aperture.

* * * * *